US006927653B2

(12) United States Patent
Uchimura et al.

(10) Patent No.: US 6,927,653 B2
(45) Date of Patent: Aug. 9, 2005

(54) DIELECTRIC WAVEGUIDE TYPE FILTER AND BRANCHING FILTER

(75) Inventors: Hiroshi Uchimura, Kokubu (JP); Kenji Kitazawa, Kokubu (JP)

(73) Assignee: Kyocera Corporation, Kyoto (JP)

( * ) Notice: Subject to any disclaimer, the term of this patent is extended or adjusted under 35 U.S.C. 154(b) by 349 days.

(21) Appl. No.: 09/997,210

(22) Filed: Nov. 28, 2001

(65) Prior Publication Data

US 2004/0041663 A1 Mar. 4, 2004

(30) Foreign Application Priority Data

Nov. 29, 2000 (JP) ..... 2000-363695
Jan. 30, 2001 (JP) ..... 2001-022252

(51) Int. Cl.[7] ..... H01P 1/20

(52) U.S. Cl. ..... 333/208; 333/239; 333/248; 333/113

(58) Field of Search ..... 333/219, 219.1, 333/239, 248, 254, 113, 208

(56) References Cited

U.S. PATENT DOCUMENTS

| | | | | |
|---|---|---|---|---|
| 5,382,931 A | | 1/1995 | Piloto et al. | |
| 5,982,256 A | * | 11/1999 | Uchimura et al. | 333/239 |
| 6,057,747 A | * | 5/2000 | Takenoshita et al. | 333/137 |
| 6,359,535 B1 | * | 3/2002 | Takenoshita et al. | 333/239 |
| 6,380,825 B1 | * | 4/2002 | Takenoshita et al. | 333/137 |
| 6,515,562 B1 | * | 2/2003 | Takenoshita et al. | 333/248 |
| 6,535,083 B1 | * | 3/2003 | Hageman et al. | 333/210 |

FOREIGN PATENT DOCUMENTS

| | | | | |
|---|---|---|---|---|
| EP | 1302999 A1 | * | 4/2003 | H01P/1/208 |
| JP | 10-173407 | | 6/1998 | |
| JP | 11355010 A | * | 12/1999 | H01P/1/207 |
| JP | 2003133809 A | * | 5/2003 | H01P/1/207 |

OTHER PUBLICATIONS

Yoneyama " Nonradiative dielectric waveguide for millimeter wave integrated circuits" IEEE Transactions on Microwave Theor and Techniques, vol. MTT–29, No. 11 Nov. 1981 pp. 1188–1192.*

Yoneyama et al "Loss Measurements of Nonradiative dielectric waveguide" IEEE Transaction on Microwave Theory and Techniques, vol. MTT–32, No. 8 Aug. 1984, pp. 943–946.*

* cited by examiner

*Primary Examiner*—Robert Pascal
*Assistant Examiner*—Kimberly Glenn
(74) *Attorney, Agent, or Firm*—Hogan & Hartson LLP

(57) ABSTRACT

A cutoff waveguide path is provided in a part of a dielectric waveguide comprising a pair of main conductive layers formed on an upper and a lower surfaces of a dielectric and groups of conductive vias arranged in the direction of signal transmission with a space of a distance less than ½ of a signal wavelength between the conductive vias, and provided in the cutoff waveguide path is a resonator having dielectric vias formed of a dielectric having a higher dielectric constant than that of a dielectric forming the dielectric waveguide. With this construction, a dielectric waveguide type filter easily designed and manufactured can be obtained.

14 Claims, 10 Drawing Sheets

DIELECTRIC WAVEGUIDE TYPE FILTER AND BRANCHING FILTER

This application is based on applications Nos. 2000-363695 and 2001-022252 filed in Japan, the content of which is incorporated hereinto by reference.

FIELD OF THE INVENTION

The present invention relates to a dielectric waveguide type filter and a dielectric waveguide type branching filter mainly used at high frequencies such as microwaves and millimeter waves and capable of being packaged in an inside of a multi-layered wiring substrate, a semiconductor package, transmitting and receiving module and the like.

DESCRIPTION OF THE RELATED ART

Recently, studies on vehicular communication, inter-vehicle radar, wireless LAN and the like used at high frequencies such as microwaves and millimeter waves have been positively progressed. These technologies using high frequencies need a band pass filter capable of passing only high frequency signals of specified frequencies, and a branching filter capable of taking out high frequency signals of specified frequencies.

(A) FIG. 12 shows an example of structure of a conventional waveguide filter. In FIG. 12, numeral 31 indicates a waveguide, numeral 32 indicating an input port, numeral 33 indicating an output port, and numerals 35, 36, 37 indicating waveguide resonators. In this waveguide filter, the waveguide 31 is provided with recessed sections 34 (which are called iris sections) at parts thereof, and resonators 35, 36, 37 are provided between the recessed sections 34 to form a three-stage filter. By controlling the characteristics of the respective resonators 35, 36, 37 and the number of the resonator stages, the characteristic of the waveguide type filter can be controlled.

Such a waveguide filter having the abovementioned structure is very hard to manufacture since waveguide walls thereof are all formed of metal plates. Therefore, U.S. Pat. No. 5,382,931 has proposed that such a structure is provided in a dielectric waveguide formed by laminating dielectric sheets.

One of the structures proposed in that USP is shown in FIG. 13A. In a dielectric substrate 40, conductive vias 38 are arranged with a distance less than ½ of the signal wavelength therebetween to form a resonator 39. This structure, as a whole, realizes a filter structure. This structure is advantageous in that it can be manufactured by applying the conventional dielectric layer laminating method.

However, the dielectric waveguide type filter has the following problems.

First, at the time of manufacturing, reducing the diameter and the pitch of the conductive vias 38 is limited. For example, when the via diameter is $\phi$0.2 mm, it is preferable to make the via pitch 0.5 mm or more. This is because, if the via pitch becomes too small, cracks are apt to be caused between the conductive vias and the reliability is lessened.

Secondly, since the conductive vias 38 constitute E surface of the dielectric waveguide, the distance therebetween must be set to be less than ½ of the signal frequency in principle. When a low frequency is used, that is, when the signal wavelength is long, the size of the resonator 39 is large as shown in FIG. 13A, and therefore, the resonator 39 can be formed by sufficient number of conductive vias even with a via pitch of 0.5 mm or more. However, when a high frequency is used, the resonator 39 becomes short as shown in FIG. 13B, and therefore, only small number of conductive vias can be disposed on the sides enclosing the resonator 39. As the case may be, the conductive vias 38 cannot be arranged within the abovementioned limitation of the via pitch. Further, a dielectric waveguide having such conductive vias 38 is very hard to design, because the equivalent waveguide size changes with the via pitch.

An object of the present invention is to provide a dielectric waveguide type filter capable of being easily designed and manufactured whether the signal frequency is high or low.

(B) Though branching filters have various structures, a waveguide branching filter comprising a rectangular waveguide is known as having an excellent band pass characteristic. For example, a waveguide branching filter as shown in a schematically perspective view of FIG. 14 is known.

A waveguide type branching filter shown in FIG. 14 comprises a waveguide 51 having a shortcut end 58, a first waveguide filter 52 and a second waveguide filter 5. The first waveguide filter 52 and the second waveguide filter 53 have iris sections 54*a* to 54*c* and iris sections 55*a* to 55*c* respectively, and are connected through connecting holes 56, 57 to the waveguide 51. Regions enclosed by the respective iris sections in the first waveguide filter 52 and the second waveguide filter 53 form TE101 mode resonators. The first waveguide filter 52 is so designed as to be a pass filter the central frequency of which is a frequency $f_1$, and the second waveguide filter 53 is so designed as to be a transmission filter the central frequency of which is a frequency $f_2$. Further, the distances from the shortcut end 58 to the connecting holes 56, 57 are set to be integral times ½ of the guide wavelengths $\lambda g1$, $\lambda g2$ at the central frequencies $f_1$, $f_2$.

When a signal of a frequency far from the central frequency $f_1$, $f_2$ enters the waveguide 51, it cannot be transmitted through the iris sections 54, 55 in the waveguide filters 52, 53 and therefore it is reflected. On the other hand, when a signal of a frequency equal to or near $f_1$, $f_2$ enters the waveguide 51, it resonates in regions enclosed by the iris sections 24, 25 in the first and second waveguides 52, 53 respectively, and the energy of the signal can be transmitted. Further, since the distances from the shortcut end 58 to the connecting holes 56, 57 are integral times ½ of the guide wavelengths $\lambda g1$, $\lambda g2$, the magnetic field strength at the positions of the connecting holes 56, 57 in the waveguide 51 becomes the largest in the direction of the long side. Therefore, a signal entering the waveguide 52 passes through the connecting holes 56, 57 to be connected to the first and the second waveguide filters 52, 53, so that a signal of a frequency equal to or near $f_1$ is transmitted through the first waveguide 52 and a signal of a frequency equal to or near f2 is transmitted through the second waveguide 53.

Such a conventional waveguide branching filter using a hollow waveguide as shown in FIG. 14 has a good band pass characteristic with respect to high frequency signals, isolation and electric power resistant characteristic. However, it has a problem that works of its manufacturing, such as fitting of the waveguide filters 52, 53 to the waveguide filter 51, are difficult. Consequently, it has a problem that the productivity is low and therefore the cost becomes high. Further, since the size of the rectangular waveguide itself is large, a branching filter using the same becomes large and is hard to be small-sized in order to be used for movable body communication, inter-vehicle radars and the like.

Recently, a small-sized waveguide type filter has been proposed in Japanese unexamined Publication No. 1998-

173405. Since this waveguide type filter is changed from a hollow waveguide to a waveguide filled with a dielectric material, it can be further small-sized.

The structure proposed in the above Japanese Publication is formed by integrally molding a dielectric block provided with iris channels. However, it is difficult to manufacture dielectric blocks with precision. For manufacturing such a waveguide type filter, a structure for controlling resonant frequencies and steps of grinding and working dielectric blocks after baking are required. Furthermore, since the strength of dielectric blocks is lower than that of the metal waveguide, cracks, breakage and the like are apt to be caused near the iris channels. Therefore, dielectric blocks have low stability and have to be protected by other members when used.

An object of the present invention is to provide a dielectric waveguide type branching filter which is high in productivity, well small-sized, and excellent in size stability and reliability.

SUMMARY OF THE INVENTION (A) The inventors of this invention have found that by arranging conductive vias in two rows and embedding, between the two rows of conductive layers, dielectric vias formed of a dielectric having a higher dielectric constant than that of a dielectric substrate to form an resonator, a dielectric waveguide can be formed and have made this invention.

A dielectric waveguide type filter according to the present invention uses a dielectric waveguide comprising a pair of main conductive layers holding an upper and a lower surfaces of a dielectric therebetween, and groups of conductive vias arranged in the direction of signal transmission with a space each of a distance less than ½ of a signal wavelength therebetween and penetrating parts near side walls of the said dielectric substrate thus to connect the pair of the main conductive layers with each other, and the said dielectric waveguide includes a resonator, the said resonator being constituted by dielectric vias formed by a dielectric having a higher dielectric constant than that of a dielectric forming the said dielectric waveguide and provided in a region enclosed by the main conductive layers and the groups of conductive vias.

According to the dielectric waveguide type filter of the present invention, the resonator is constituted by a dielectric having a higher dielectric constant than that of the dielectric forming the dielectric waveguide. Regardless of a signal frequency, the resonator can be formed with a constant width of dielectric waveguide, and the resonator and the filter can be easily designed. Further, the conductive vias constituting side walls of the dielectric waveguide can be formed with a constant pitch, so that the dielectric waveguide type filter can be easily designed and manufactured. Further, according to the conventional method of manufacturing a multi-layered wiring substrate, the resonator and the filter can be easily contained in various kinds of multi-layered substrates. Furthermore, the dielectric waveguide filer can be easily manufactured by a sheet laminating method such as a green sheet laminating method, and therefore, it can be manufactured with high reliability and productivity and at low cost.

The abovementioned resonator may be disposed in a cutoff waveguide path provided in the dielectric waveguide.

Further, auxiliary conductive layers electrically connecting the adjacent conductive vias to each other may be provided in the E surfaces constituted by the said conductive vias. Thereby the dielectric waveguide can be formed of a plurality of dielectric layers. Since the thickness of the waveguide can be made large, the loss can be reduced.

Further, by providing a plurality of dielectric vias and changing the arrangement of the dielectric vias, the resonant characteristic can be controlled. Especially, the effective dielectric constant can be made lager by arranging the dielectric vias on the central axis of the cutoff waveguide path and/or in the bilaterally symmetrical positions with respect to the central axis.

Further, by selecting the dielectric material forming the dielectric waveguide to be a low temperature baked ceramic and forming the conductive vias of low resistance metals such as copper, aluminum and silver, occurrence of breakage of conductive members can be reduced.

Especially, by setting the dielectric constant of the abovementioned dielectric vias to be higher than two times the dielectric constant of the dielectric of the dielectric waveguide, the property of the resonator can be highly improved.

It is possible to arrange a plurality of the abovementioned resonators having a predetermined resonant characteristic in series. Thereby, a dielectric waveguide type filter having a plurality of resonant characteristics of staggered central frequencies can be formed.

(B) The inventors of this invention have found that by forming a dielectric waveguide type filter using a dielectric waveguide comprising a combination of a pair of conductive layers and a plurality of conductive vias in place of a conventional rectangular waveguide and have made this invention.

A dielectric waveguide type branching filter according to the present invention includes a common dielectric waveguide and a dielectric waveguide type filter connected to the common dielectric waveguide, and the said dielectric waveguide type filter comprises a pair of main conductive layers holding the upper and the lower surfaces of a dielectric therebetween and conductive via groups arranged in the direction of signal transmission with spaces each of a distance less than ½ of a signal wavelength therebetween and penetrating parts near side walls of a dielectric substrate thus to connect the pair of the main conductive layers with each other.

This dielectric waveguide type branching filter according to the present invention, in which a dielectric waveguide is used for a filter, can be formed smaller-sized in comparison with a conventional branching filter using a rectangular hollow waveguide. Further, since it is fabricated into a dielectric substrate such as a multi-layered wiring substrate, it is a dielectric waveguide type branching filter to be easily small-sized. Further, since it can be easily manufactured according to a sheet laminating method such as a green sheet method, it can be provided with high productivity and at low cost.

Further, according to the present invention, similarly to the abovementioned dielectric waveguide type filter, the abovementioned common dielectric waveguide can comprise, a pair of main conductive layers holding the upper and the lower surfaces of a dielectric therebetween and conductive via groups arranged in the direction of signal transmission with spaces each of a distance less than ½ of a signal wavelength therebetween and penetrating parts near side walls of a dielectric substrate thus to connect the pair of the main conductive layers with each other. It is preferable that the respective main conductive layers of the dielectric waveguide type filter and the common dielectric waveguide are formed in common, and the dielectric waveguide type filter can be easily connected to the conductive via groups of the common dielectric waveguide. As a result, the whole structure of the dielectric waveguide type branching filter can be easily integrated.

Further, it is preferable that the property of the abovementioned dielectric waveguide type filter can be easily controlled by providing a plurality of shortcut conductors and/or dielectric vias having another dielectric constant than that of the dielectric substrate for electrically connecting the main conductive layers to each other in the region enclosed by the main conductive layers and the conductive via groups.

The structure of the embodiments of the present invention will be described in the following with reference to the appended drawings.

DETAILED DESCRIPTION OF THE INVENTION

1. Dielectric Waveguide

Figure 1:
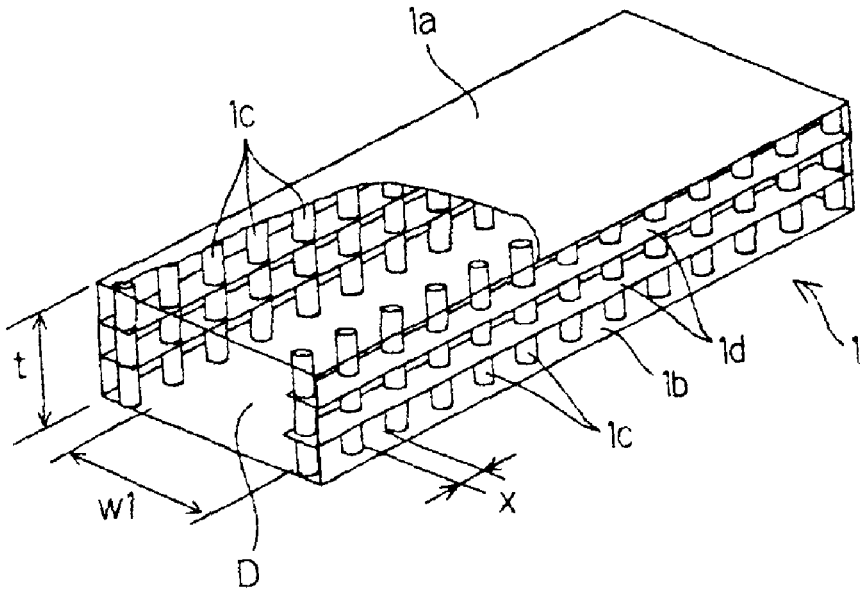
FIG. 1 is a schematically perspective view for explaining a structure of a dielectric waveguide.

FIG. 1 is a schematically perspective view for explaining a detailed structure of a dielectric waveguide. Though this figure is an opened-up view with a dielectric being regarded as transparent, the inside of a dielectric waveguide 1 is filled with dielectric D in fact.

In the dielectric waveguide 1 according to the present invention, a pair of main conductive layers 1*a*, 1*b* are disposed in parallel with a predetermined distance t therebetween on the upper and lower surfaces of the dielectric D. These main conductive layers 1*a* and 1*b* constitute H surfaces. In order to electrically connect the main conductive layers 1*a* and 1*b* to each other, a plurality of conductive via group 1*c* are provided vertically to the main conductive layers 1*a* and 1*b* and with a predetermined distance x therebetween. The vias 1*c* are arranged in two columns i.e. a right and a left columns. The width between the two columns is represented by w1. These conductive via group 1*c* constitute E surfaces i.e. side walls of the dielectric waveguide 1.

The distance x between the mutual conductive via group 1*c* is set to less than a half of a signal wavelength. When the distance x is less than a half of a signal wavelength, electromagnetic waves are transmitted without leakage. The distance x between the mutual conductive via group 1*c* is important in view of preventing signals from leaking out of the side walls. Further, the width w1 between the columns of the conductive via group 1*c* is usually set to be 0.65 to 0.95 times of a signal wavelength. The distance t between the main conductive layers 1*a*, 1*b* is not particularly limited, but it is set to be a half of w1 when the dielectric waveguide 1 is used in a single mode.

Further, in order to mutually electrically connect adjacent conductive via group 1*c* in the vias 1*c* group in each column, an auxiliary conductive layer 1*d* is provided in parallel with the main conductive layers 1*a*, 1*b*. Since each of the side walls of the dielectric waveguide 1 can be constituted by a latticework formed of the conductive via group 1*c* and the auxiliary conductive layer 1*d*, the side walls (E surfaces) have an increased electromagnetic wave shielding effect.

The conductive via group 1*c* are arranged in two columns in the abovementioned embodiment. However, by arranging the conductive vias in four or six columns to form double or triple conductor walls, leakage of the electromagnetic waves from the conductor walls can be more effectively prevented.

The waveguide size of the abovementioned dielectric waveguide 1 is $1/\sqrt{\in}$ of an ordinary hollow waveguide when the dielectric constant of a dielectric substrate D1 is $\in$.

Accordingly, the larger the dielectric constant $\in$ of the material of the dielectric D becomes, the smaller the waveguide size can be. As a result, the dielectric waveguide 1 can be of a size usable as a multi-layered wiring substrate or a semiconductor element containing package in which highly dense wiring is formed, or a transmitting line of an inter-vehicle radar.

2. Dielectric Waveguide Type Filter

Figure 2:
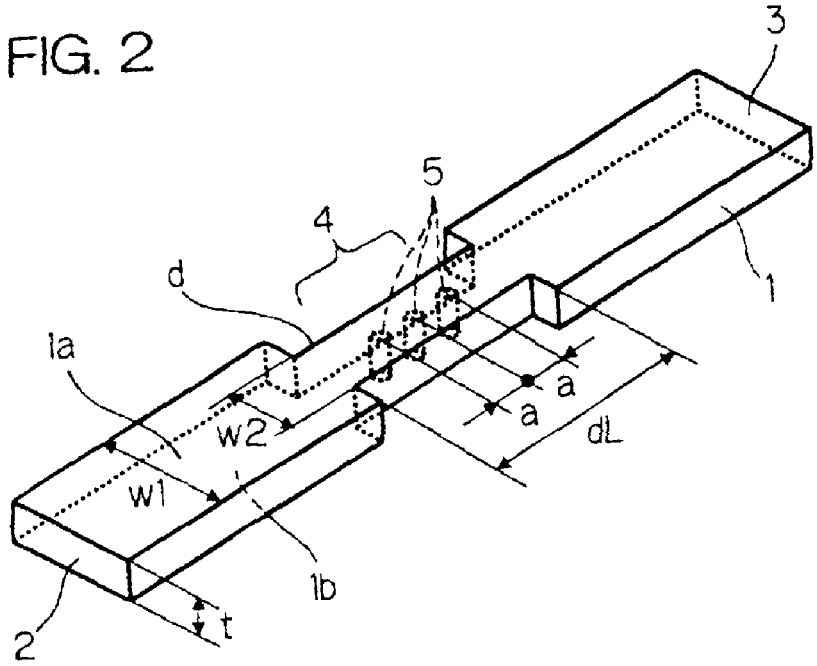
FIG. 2 is a schematically perspective view of an embodiment of a dielectric waveguide type filter according to the present invention.

FIG. 2 is a schematically perspective view showing an embodiment of a dielectric waveguide type filter according to the present invention.

In FIG. 2, illustration of conductive vias constituting side walls of a dielectric waveguide 1 is omitted. In this Figure, numeral 1 indicates a dielectric waveguide, numeral 2 indicating an input port, numeral 3 indicating an output port, and numeral 4 indicating a resonator.

The structure of this dielectric waveguide 1, 4 based on that of the dielectric waveguide shown in FIG. 1. The input port 2 is provided at one end of the dielectric waveguide 1, and the output port 3 is provided at the other end thereof.

Provided between the input port 2 and the output port 3 is the resonator 4, the width w2 of which is smaller than the width w1 of the dielectric waveguide 1. By thus reducing the width of the waveguide than the waveguide width w1 capable of transmitting signals, that is, setting the same to be less than a half of a signal wavelength, electromagnetic waves having a wavelength larger than the signal wavelength is transmitted with loss at this narrowed portion. Therefore, this narrowed portion is called cutoff waveguide pass d.

In the dielectric waveguide type filter shown in FIG. 2, provided in the region of the cutoff waveguide path d are three dielectric vias 5 each filled with a dielectric having a dielectric constant ∈d higher than the dielectric constant ∈r of the dielectric filled in the dielectric waveguide. The three dielectric vias 5 are arranged in a column along the central axis of the waveguide with a center distance a therebetween. By thus providing the abovementioned dielectric vias 5 in the cutoff waveguide path d, the effective dielectric constant of a part of the cutoff waveguide path can be raised. Thereby, the resonator 4 is formed.

Figure 3:
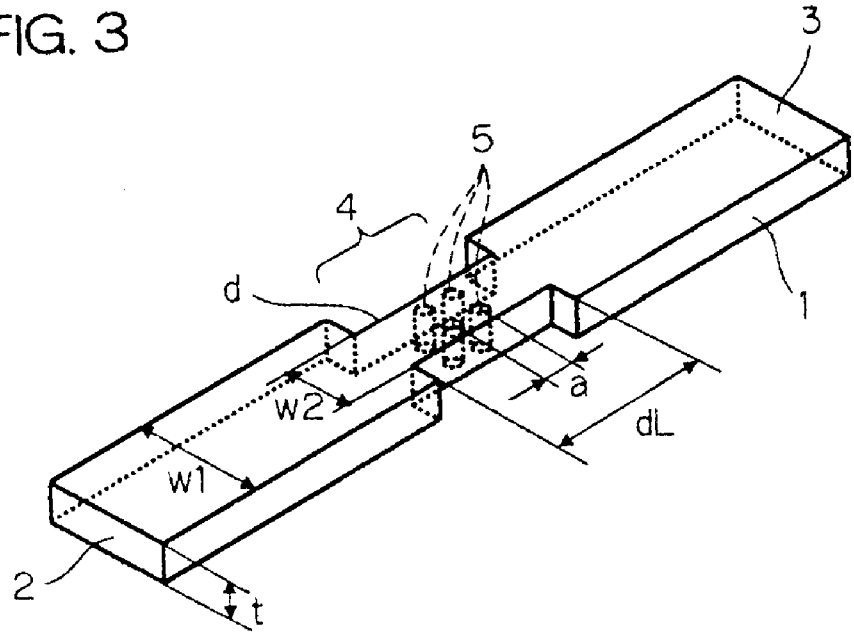
FIG. 3 is a schematically perspective view of another embodiment of a dielectric waveguide type filter according to the present invention.

One dielectric via or a plurality of dielectric vias 5 may be provided in the cutoff waveguide path d, but it is desirable to provide a plurality of dielectric vias 5 in order to raise the effective dielectric constant. Further, the dielectric vias 5 may be arranged in a column as shown in FIG. 2 or in two columns as shown in FIG. 3 in the cutoff waveguide path d. If the dielectric vias 5 are arranged in two columns as shown in FIG. 3, the length of the resonator 4 can be advantageously smaller than that in the case of the dielectric vias 5 arranged in a column as shown in FIG. 2.

Further, the resonant frequency of the resonator 4 can be controlled by the dielectric constant ∈d of the dielectric filled in the dielectric vias 5, the number of the dielectric vias 5, or the position of the waveguide in the direction of the width. Especially, the dielectric constant ∈d of the dielectric filled in the dielectric vias 5 is preferably more than two times the dielectric constant ∈r of the dielectric filled in the dielectric waveguide.

Further, though the diameter of the dielectric vias 5 is determined in consideration of a necessary resonant characteristic, it is preferably less than a half of the thickness of a dielectric sheet constituting the dielectric waveguide.

Figure 4:
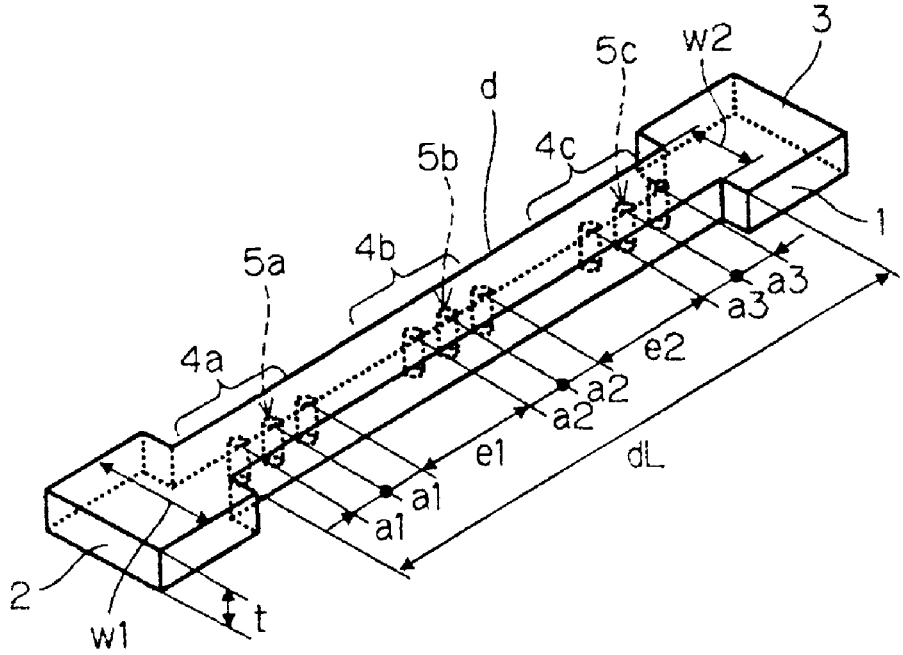
FIG. 4 is a schematically perspective view of a further embodiment of a dielectric waveguide type filter according to the present invention.

FIG. 4 is a schematically perspective view of another embodiment of a dielectric waveguide type filter according to the present invention. The dielectric waveguide type filter shown in FIG. 4 is provided with three resonators 4*a*, 4*b*, 4*c* in a cutoff waveguide path d. In the resonators 4*a*, 4*b*, 4*c* provided in the cutoff waveguide path d, dielectric vias 5*a*, 5*b*, 5*c* are respectively disposed with a center distance $a_1$, $a_2$, $a_3$ therebetween. And the resonators 4*a*, 4*b*, 4*c* are mutually spaced with distances $e_1$, $e_2$ respectively therebetween. In such a dielectric waveguide type filter, the attenuation amount can be controlled in a band region out of the central frequency by controlling the resonant characteristic of the resonators 4*a*, 4*b*, 4*c*, that is, the respective positions of the dielectric vias 5*a*, 5*b*, 5*c* and the length dL of the cutoff waveguide path dL. Further, the filter characteristic can be controlled by controlling the dielectric constants of the dielectric vias 5*a*, 5*b*, 5*c* respectively. Furthermore, though in the abovementioned three embodiments of the present invention shown in FIGS. 2, 3, 4, the dielectric vias 5 penetrate the dielectric waveguide from the main conductive layer 1*a* to the main conductive layer 1*b*, the dielectric vias 5 need not necessarily penetrate the dielectric from the main conductive layer 1*a* to the main conductive layer 1*b*. For example, when the dielectric is formed of a multi-layered body of dielectric layers, it is also possible to provide dielectric vias only in a specified dielectric layer between the main conductive layer 1*a* to the main conductive layer 1*b*.

3. Dielectric Waveguide Type Branching Filter

An embodiment of a dielectric waveguide type branching filter, in which the structure of the dielectric waveguide shown in FIG. 1 is used, will be now described with reference to the drawings.

Figure 8:
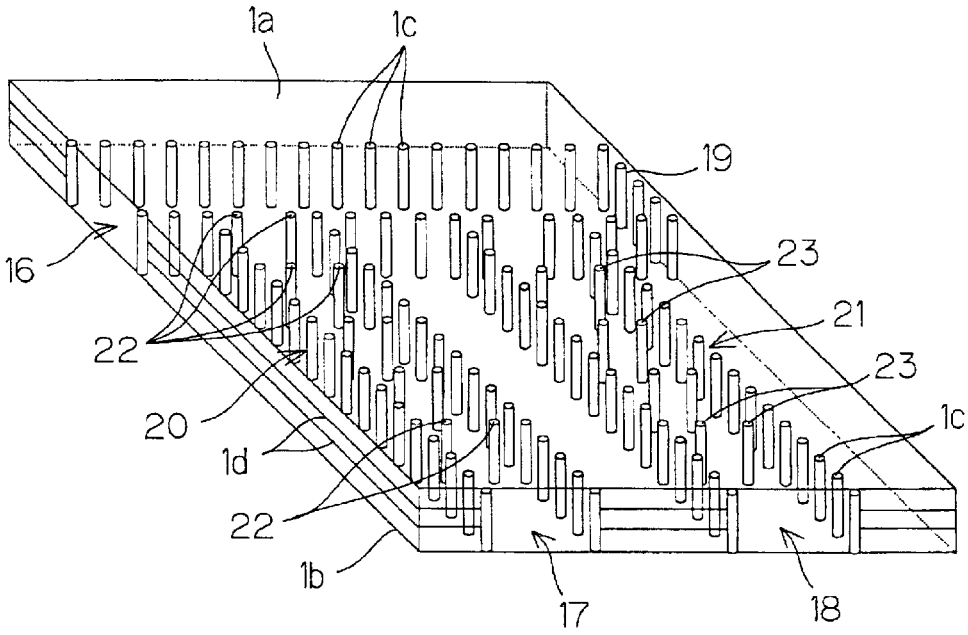
FIG. 8 is a schematically perspective view of an embodiment of a dielectric waveguide type branching filter according to the present invention.
Figure 9:
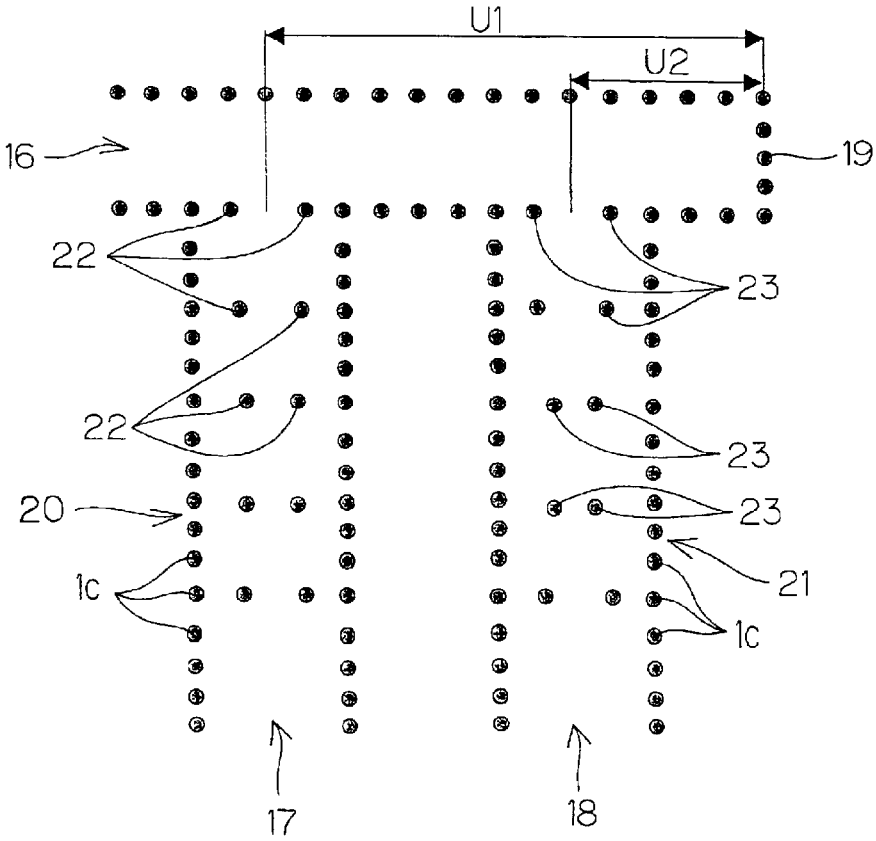
FIG. 9 is a plan view of a dielectric waveguide type branching filter of FIG. 8.

FIG. 8 is a schematically perspective view showing a first embodiment of a dielectric waveguide type branching filter according to the present invention, and FIG. 9 is a plan view of the same. This embodiment of a dielectric waveguide type branching filter is formed by connecting a common dielectric waveguide 16 and two band pass type dielectric waveguide type filters 20, 21 each constituting a plurality of TE101 mode resonators in a horizontal plane.

In concrete, characters 1*a*, 1*b* indicate a pair of main conductive layers. 1*c* indicates conductive vias and 1*d* indicates auxiliary conductive layer. These main conductive layers 1*a*, 1*b*, conductive via group 1*c*, and auxiliary conductive layer 1*d* have basically the same functions with the functions of those of the dielectric waveguide 1 explained with reference to FIG. 1 respectively.

In the dielectric waveguide type branching filter shown in FIGS. 8, 9, a common dielectric waveguide 16 having a shortcut wall 19 at one end thereof is provided. And at portions spaced by predetermined distances U1, U2 respectively from the shortcut wall 19 in the common dielectric waveguide 16, dielectric waveguide type filters 20, 21 respectively having central frequencies $f_1$, $f_2$ are connected. The other ends of the dielectric waveguide type filters 20, 21 are connected through shortcut conductors 22, 23 to dielectric waveguides 17, 18 respectively.

The distances U1, U2, which determine the connecting positions of the dielectric waveguide type filters 20, 21 to the common dielectric waveguide 16, are so controlled as to obtain an impedance match in the and pass region of the dielectric waveguide type filters 20, 21.

The dielectric waveguide type filter 20 has side walls constituted by two columns of conductive via group 1*c*. In a region enclosed by the two columns of conductive via group 1*c* and the main conductive layers 1*a*, 1*b* and at a connecting portion with the common dielectric waveguide 16, shortcut conductors 22 connecting the main conductive layers 1*a*, 1*b* to each other are provided by twos with a predetermined space therebetween at five portions including the connecting portion with the common dielectric waveguide 16.

The dielectric waveguide type filter 21 has side walls constituted by two columns of conductive via group 1*c*. In a region enclosed by the two columns of conductive via group 1*c* and the main conductive layers 1*a*, 1*b* and at a connecting portion with the common dielectric waveguide 16, shortcut conductors 23 connecting the main conductive layers 1*a*, 1*b* to each other are provided by twos with a predetermined space therebetween at five portions including the connecting portion with the common dielectric waveguide 16.

These shortcut conductors 2, 23 are formed by embedding conductive paste into the dielectric similarly to the case of forming the conductive via group 1*c*.

In the case of providing the shortcut conductors 22, 23, the respective space between the shortcut conductors 22, 23, and the number, size and the like of the shortcut conductors 22, 23 have delicate influences on the band pass characteristic. Therefore, an operator repeats computing using electromagnetic field analysis so as to satisfy a required band pass characteristic. Thereby a dielectric waveguide type branching filter having a desired band pass characteristic can be obtained. The band central frequencies are represented by $f_1$, $f_2$, respectively.

Further, the distance $U_1$ from the shortcut end 19 to the dielectric waveguide type filter 20 is set to be about a fourth of the guide wavelength $\lambda g_1$ at the frequency $f_1$ or an odd numbered times the same while the distance $U_2$ from the shortcut end 19 to the dielectric waveguide type filter 21 is set to be about a fourth of the guide wavelength $\lambda g_2$ at the frequency $f_2$ or an odd numbered times the same.

If a radio wave incident on the common dielectric waveguide 16 has a frequency f far from the frequency $f_1$, the shortcut conductors 22 of the dielectric waveguide type filter 20 do not transmit energy and therefore the signal is reflected. On the other hand, a radio wave having a frequency near $f_1$ resonates in the region enclosed by the shortcut conductors 22. Consequently, the common dielectric waveguide 16 and the dielectric waveguide type filter 20 efficiently connect to each other, and the signal having the frequency near $f_1$ is branched by the dielectric waveguide type filter 20.

If a radio wave incident on the common dielectric waveguide 16 has a frequency f far from the frequency $f_2$, the shortcut conductors 23 of the dielectric waveguide type filter 21 do not transmit energy and therefore the signal is reflected. On the other hand, a radio wave having a frequency near $f_2$ resonates in the region enclosed by the shortcut conductors 23. Consequently, the common dielectric waveguide 16 and the dielectric waveguide type filter 21 efficiently connect to each other, and the signal having the frequency near $f_2$ is branched by the dielectric waveguide type filter 21.

The branched signals pass the dielectric waveguide type filters 20, 21 and are connected through the shortcut conductors 22, 23 to the common dielectric waveguide 17, 18 to be lead to outer circuits, respectively.

Further, in the abovementiond embodiment A shown in FIGS. 8, 9, the dielectric waveguide type filters 20, 21 are provided with TE101 mode resonators. In this case, the number of the resonator maybe any number if it is two or more than two. The resonant mode can be also set as desired.

Now, a second embodiment of a dielectric waveguide type branching filter according to the present invention will be described with reference to a schematically perspective view of FIG. 10 and a plan view of FIG. 11.

In a dielectric waveguide type branching filter of this embodiment, two dielectric waveguide type filters 20, 21 are connected to a common dielectric waveguide 16. And in this embodiment, in order to constitute the dielectric waveguide type filter 20, 21, a dielectric substrate and dielectric vias 24, 25 formed by embedding different kinds of dielectric paste having different dielectric constants respectively in the filter range are used in place of the shortcut conductors 22, 23 used in the abovementioned embodiment.

Further, at connecting portions between the dielectric waveguide type filters 21, 22 and the common dielectric waveguide 16, shortcut conductors 22, 23 forming connecting bores are provided.

Operation of this dielectric waveguide type branching filter is similar to that of the dielectric waveguide type branching filter having the shortcut conductors of the abovementioned embodiment.

The characteristic of this dielectric waveguide type branching filter is controlled by the dielectric constant of the dielectric filled into the dielectric vias 24, 25 and the size of the dielectric vias 24, 25. Therefore, an operator repeats computing using electromagnetic field analysis so as to satisfy a required band pass characteristic. Thereby a dielectric waveguide type branching filter having a desired band pass characteristic can be obtained.

4. Material and Manufacturing Method

Dielectric materials used for forming the dielectric waveguide 1 shown in FIG. 1, the dielectric waveguide type filters shown in FIGS. 2 to 4 and dielectric waveguide type branching filters shown in FIGS. 8 to 11 are not especially limited if they have characteristics functioning as dielectric and not hindering transmission of high frequency signals. However, in view of precision at the time of forming transmitting lines and easiness of manufacturing, it is preferable that the dielectric materials comprise ceramics. For example, they are at least one kind of ceramics selected from a group consisting of alumina ceramics, glass ceramics and aluminum nitride ceramics.

Especially, the dielectric material used for forming the dielectric waveguide is preferably a ceramic material which can be baked at a low temperature. It is because a dielectric material other than that used for the dielectric waveguide has to be embedded in the dielectric vias, 24, 25, and reaction between the dielectric material of the dielectric waveguide and that of the dielectric vias at the time of baking has to be avoided as much as possible. Especially, a dielectric material capable of being baked at a temperature of 1050° C. or below is preferably used for the dielectric waveguide. A ceramic material capable of being baked at a low temperature may comprise, for example, one composed of 10 to 90% by weight of borosilicate glass powder or glass powder and 90 to 10% by weight of a kind selected from a group consisting of alumina, silica, mullite and aluminum nitride can be use. This ceramic material can be baked at 800 to 1050° C.

The dielectric waveguide is manufactured according to the following method. An adequate organic solvent is added to ceramic material powder and mixed to make slurry-like mixture. Then the mixture is made into sheets by the doctor blade method, the calendar roll method or the like, so that a plurality of ceramic green sheets can be obtained.

For example, when the electric material is glass ceramics, the pair of main conductive layers 1*a*, 1*b* are manufactured according to a method comprising steps of adding an adequate oxide such as glass, silica, or the like and an organic solvent to at least one metal powder selected from a group consisting of cupper, silver and gold to make a paste, printing the paste on the ceramic green sheet so as to completely enclose at least the transmitting line by the thick layer printing method, and then baking the same at a temperature as high as 1000° C. so as to have a thickness more than 10 to 15 $\mu$m.

When the dielectric material is alumina ceramics, the abovementioned metal powder is preferably one selected from a group consisting of tungsten, molybdenum and manganese. And when the dielectric material is aluminum nitride ceramics, the metal powder is preferably one selected from a group consisting of tungsten and molybdenum. Further, the thickness of the main conductive layers 1*a*, 1*b* are preferably 5 to 50 $\mu$m.

The conductive vias constituting the conductive via group 1*c* and the shortcut vias 22, 23 can be formed of, for example, via hole conductors, through hole conductors or the like, and these conductive vias are manufactured by the shape of the section of the conductive vias may be circular one which can be easily manufactured, or polygonal one such as rectangle and rhomb, embedding metal paste similar to one used for the main conductive layers 1*a*, 1*b* into through holes formed by punching the ceramic green sheet, and then baking the same at the same time with baking the dielectric. The diameter of these conductive vias is preferably 50 to 300 $\mu$m.

Figure 10:
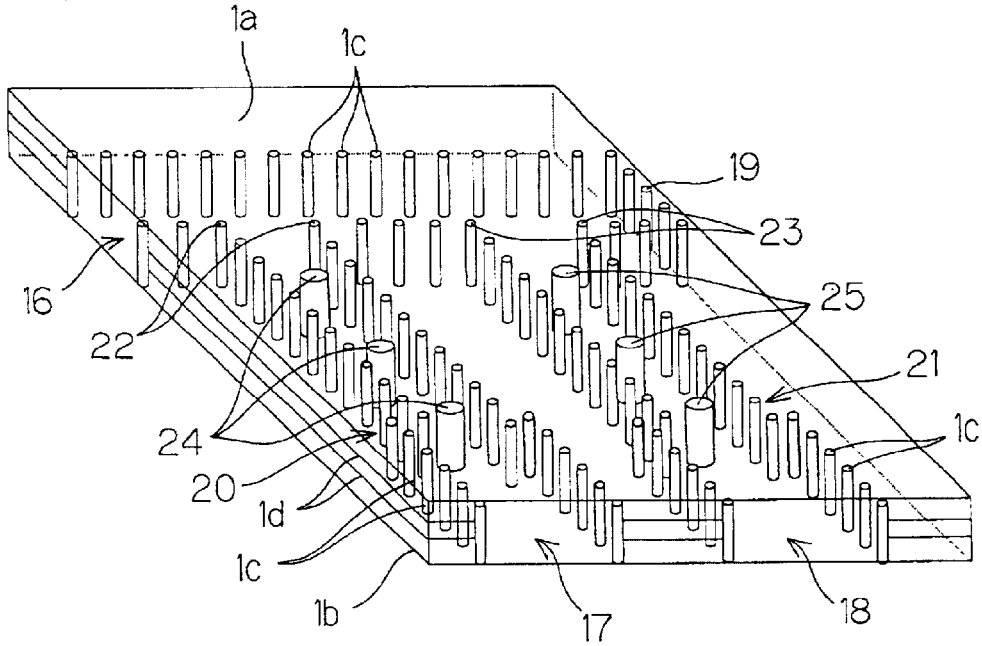
FIG. 10 is a schematically perspective view of another embodiment of a dielectric waveguide type branching filter according to the present invention.
Figure 11:
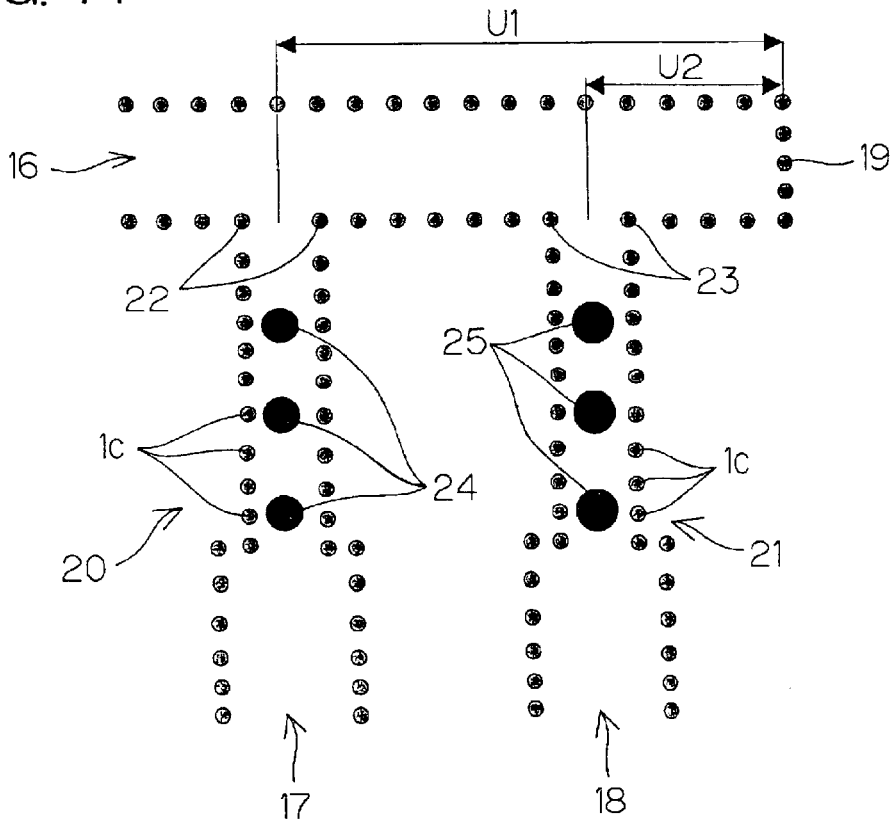
FIG. 11 is a plan view of a dielectric waveguide type branching filter of FIG. 10.
Figure 12:
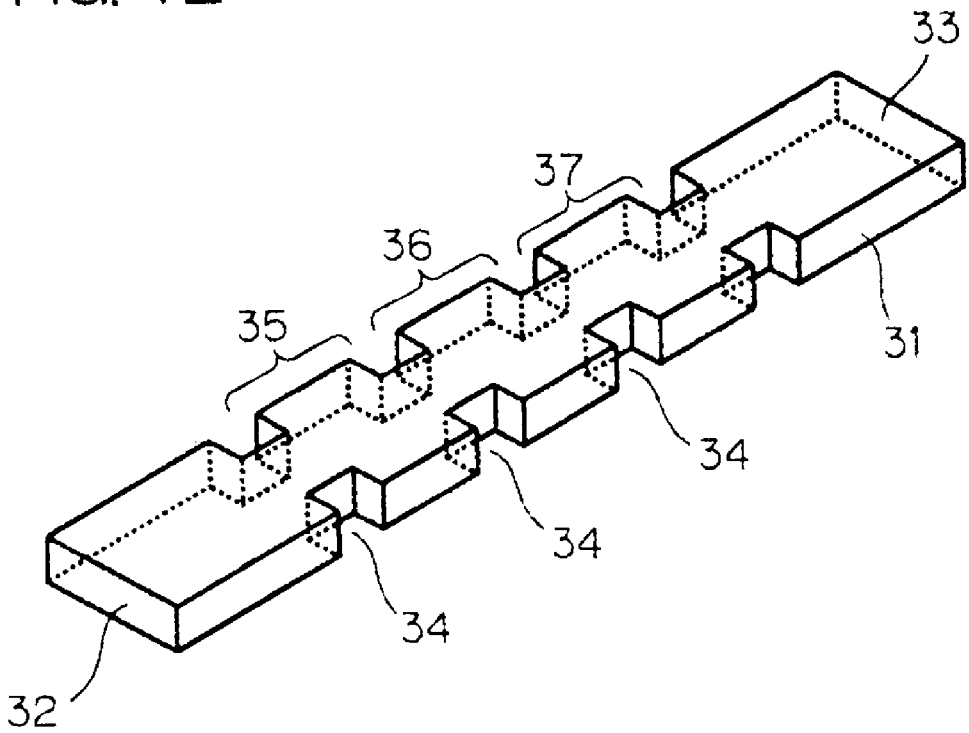
FIG. 12 is a schematically plan view for explaining a structure of a conventional waveguide type filter.
Figure 13A:
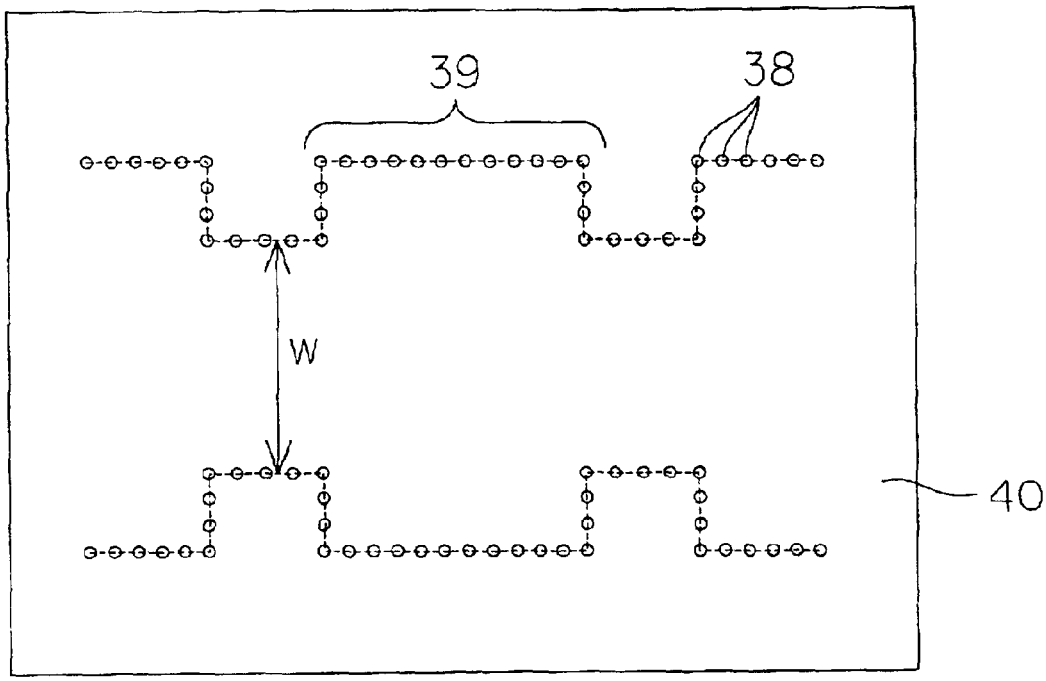
FIGS. 13A and 13B are schematically plan views for explaining a structure of a conventional dielectric waveguide type filter.
Figure 13B:
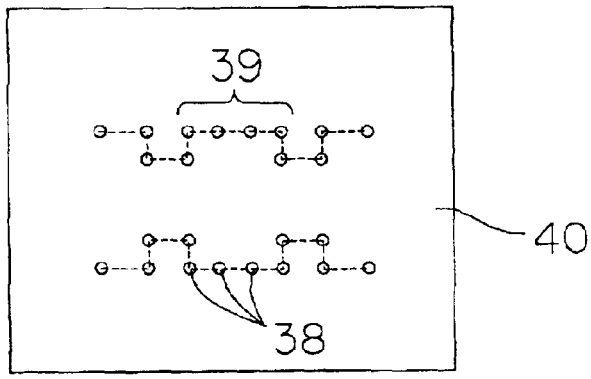
Figure 14:
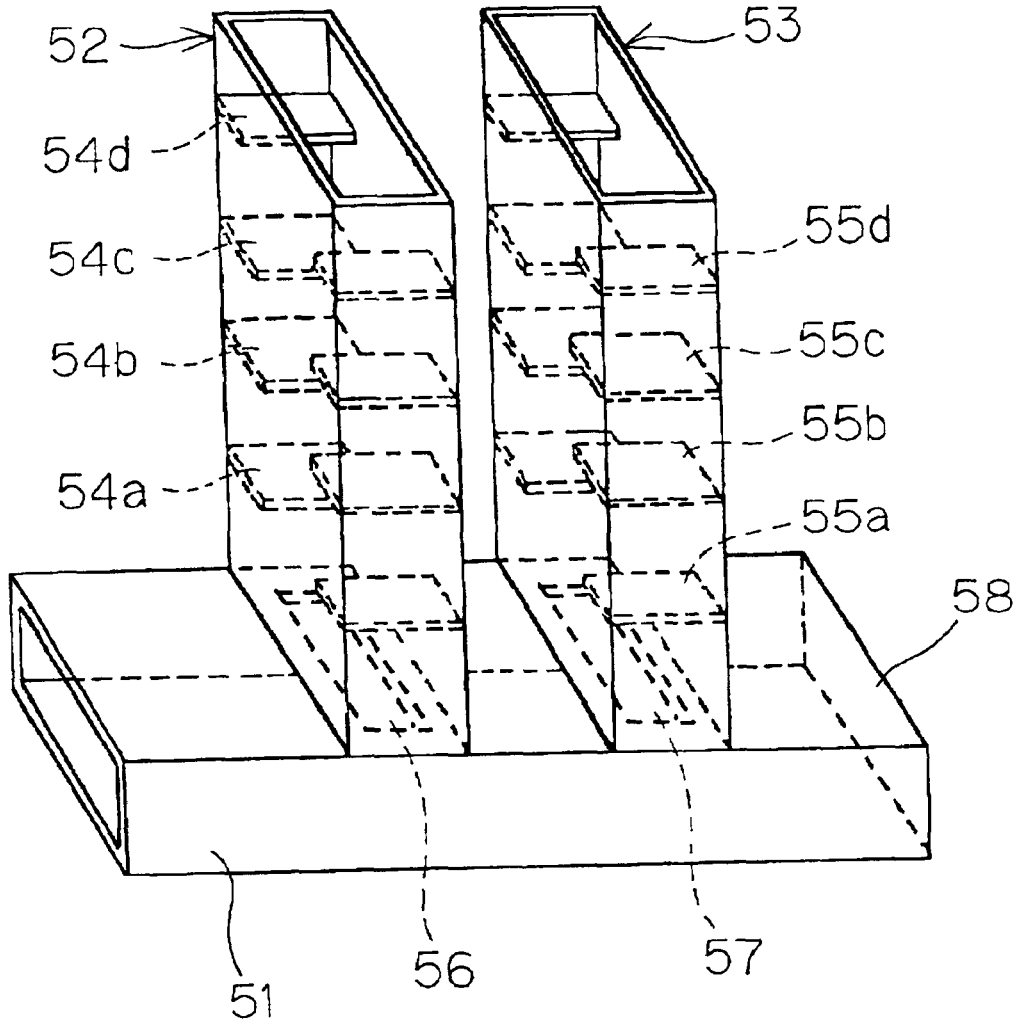
FIG. 14 is a schematically plan view showing an example of a conventional waveguide type branching filter.

The dielectric vias provided in the dielectric waveguide type branching filter shown in FIGS. 10, 11 can be manufactured by forming, for example, via holes or troughs in the dielectric and then filling an dielectric material into the same. The shape of the section of the dielectric vias 24, 25 may be circular one which can be easily manufactured, or polygonal one such as rectangle and rhomb.

The dielectric material forming the dielectric vias has only to be a material having a dielectric constant other than that of the dielectric substrate D, but especially a dielectric material having a dielectric constant four times that of the dielectric substrate D is preferred. Further, the dielectric material preferably has substantially the same thermal expansion coefficient (less than $\pm 4\times 10^{-6}/°$ C.) with that of the dielectric material forming the dielectric substrate D, and when it comprises a ceramics, the baking temperature of the same is preferably near the dielectric material of the dielectric substrate D. The diameter of the dielectric vias 24, 25 is preferably 50 $\mu$m to 2 mm, more preferably 50 $\mu$m to 500 $\mu$m.

The dielectric waveguide, the dielectric waveguide type filter and the dielectric waveguide type branching filter can be manufactured by positioning and integrally laminating the green sheets formed as abovementioned, and then baking the same at a predetermined temperature.

EXAMPLE 1

Figure 5:
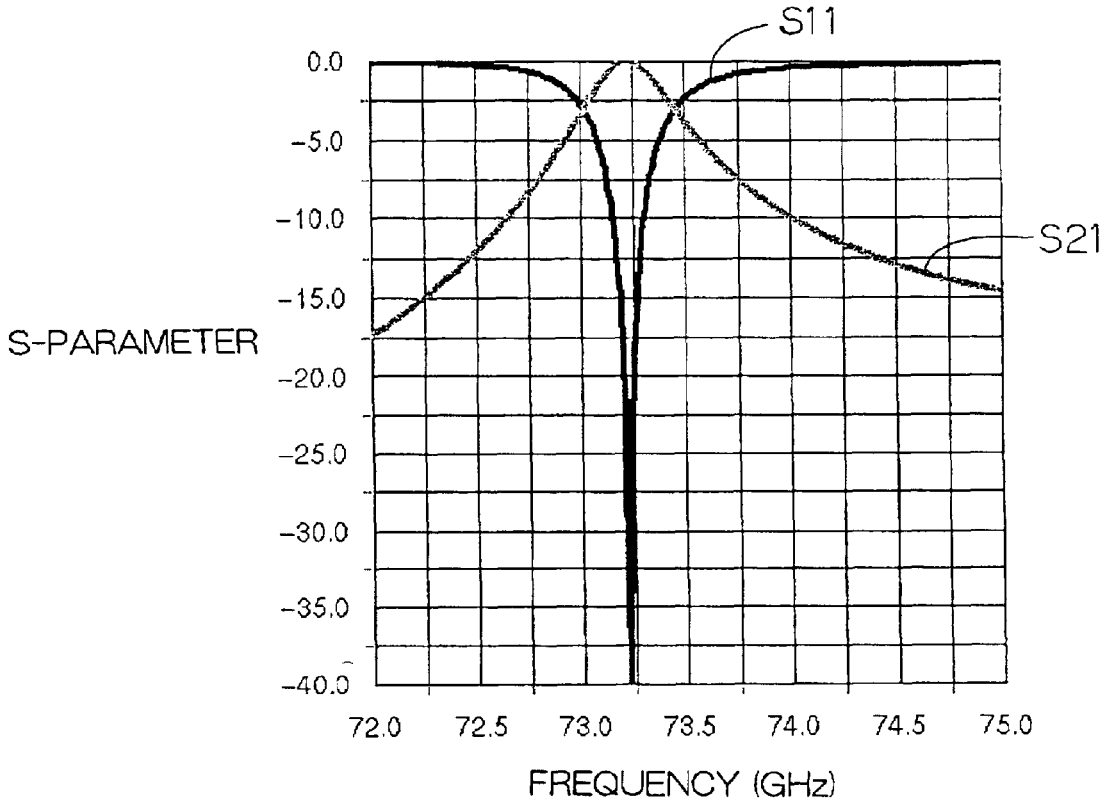
FIG. 5 is a graph showing a transmittance characteristic of a filter manufactured using a resonator shown in FIG. 2.

A dielectric waveguide type filter shown in FIG. 2 was manufactured. The transmittance characteristic of the filter is shown in FIG. 5. Parameters of the filter were as follows. Of the basic dielectric waveguide, the dielectric constant $\in r=4.9$, the width of the waveguide $W_1=1.6$ mm, and the thickness of the waveguide t=0.48 mm. Of the resonator 4, the width of the cutoff waveguide $w_2=0.8$ mm, the length of the cutoff waveguide path dL=2.6 mm, the dielectric constant of the dielectric in the dielectric vias $\in d=20.0$, the dielectric via diameter b=$\phi$0.2 mm, and the dielectric via pitch (center distance) a=0.5 mm. Further, the dielectric vias 5 were arranged in a column along the central axis of the cutoff waveguide path d.

As a result, as shown in FIG. 5, a characteristic that the resonant frequency is 73.2 GHz and the transmittance frequency band width is 0.5 GHz was obtained, and it proves that such a structure functions as a filter.

EXAMPLE 2

Figure 6:
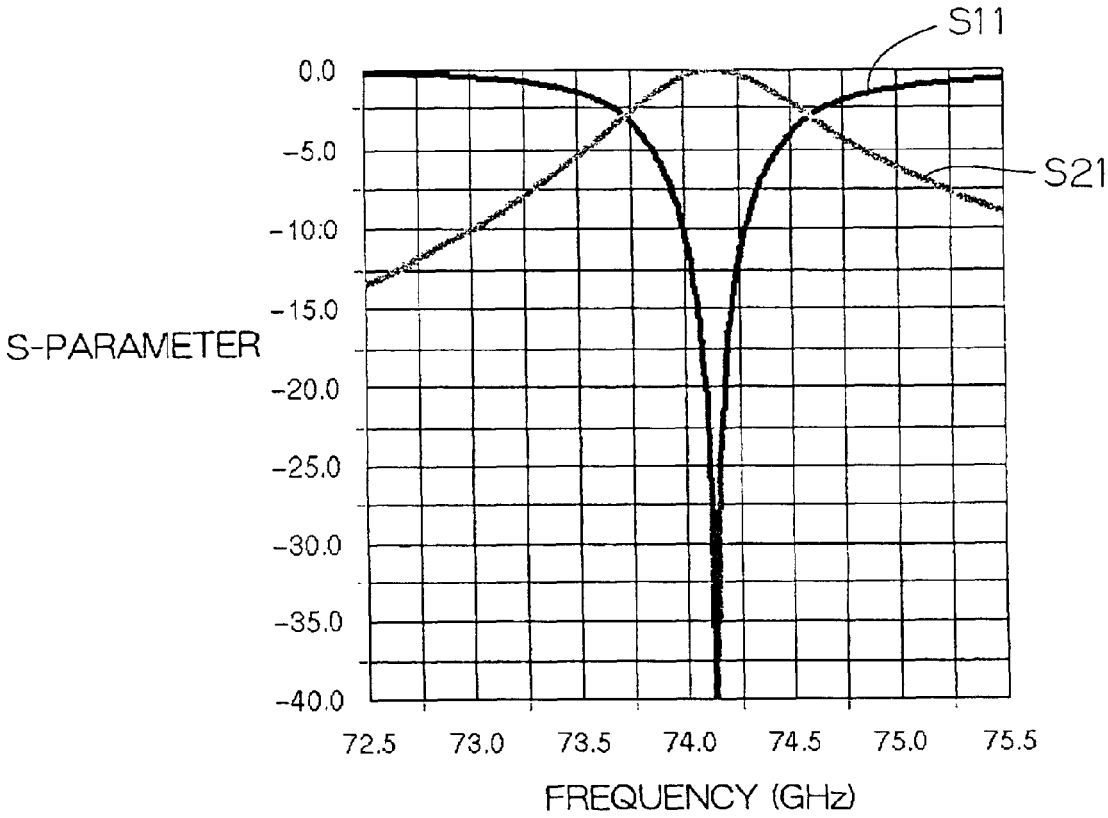
FIG. 6 is a graph showing a transmittance characteristic of a filter manufactured using a resonator shown in FIG. 3.

A dielectric waveguide type filter shown in FIG. 3 was manufactured. The transmittance characteristic of the filter is shown in FIG. 6. Parameters of the filter were as follows. Parameters of the basic dielectric waveguide were the same with those of Example 1. Of the resonator 4, the width of the cutoff waveguide $w_2=0.8$ mm, the length of the cutoff waveguide path dL=2.0 mm, the dielectric constant of the dielectric in the dielectric vias $\in d=20.0$, the dielectric via diameter b=$\phi$0.2 mm, and the dielectric via pitch (center distance) a=0.4 mm. Further, the dielectric vias 5 were arranged in a column along the central axis of the cutoff waveguide path d.

In this case, a characteristic that the resonant frequency is 74.1 GHz and the transmittance frequency band width is 0.9 GHz was obtained, and it proves that such a structure functions as a filter. It is understood in comparison with Example 1 that the transmittance characteristic can be controlled by controlling the positions of the dielectric vias and the length of the cutoff waveguide.

EXAMPLE 3

Figure 7:
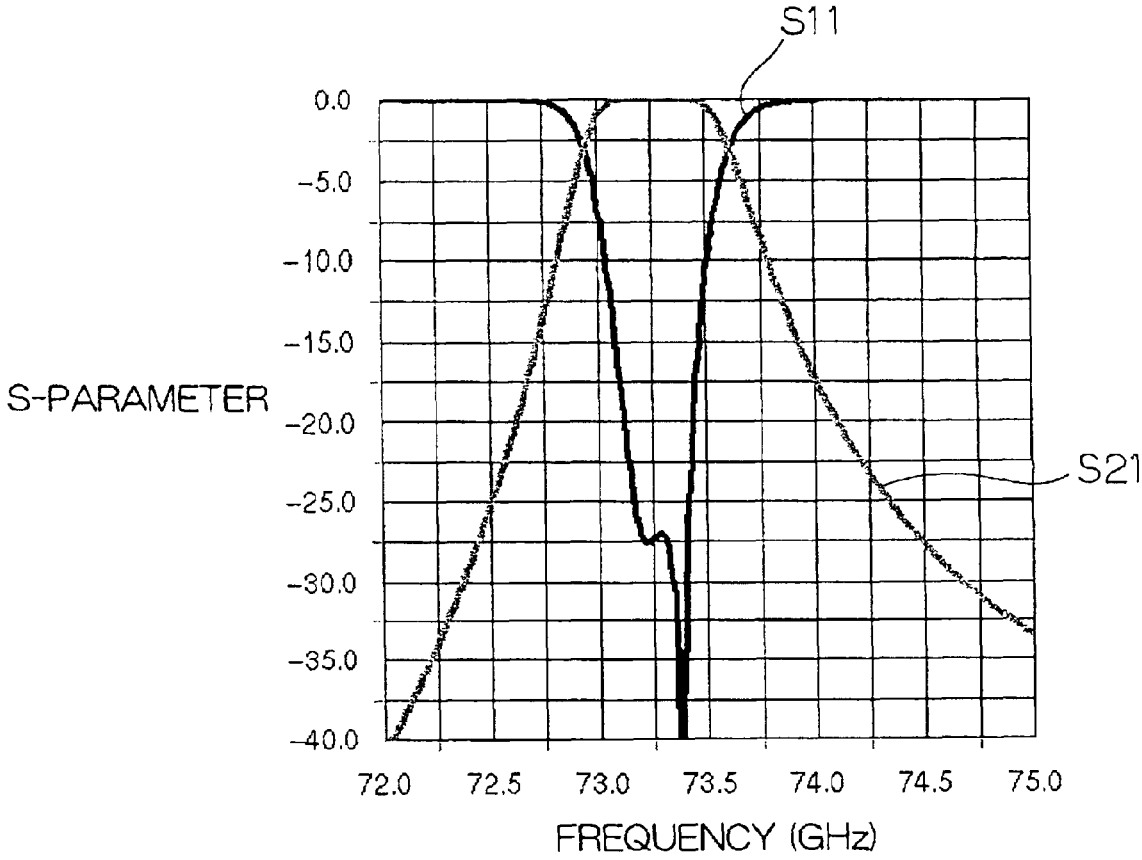
FIG. 7 is a graph showing a transmittance characteristic of a filter manufactured using a resonator shown in FIG. 4.

A dielectric waveguide type filter shown in FIG. 4 was manufactured. The transmittance characteristic of the filter is shown in FIG. 7. Parameters of the filter were as follows. Parameters of the basic dielectric waveguide were the same with those of Example 1. Of the resonator 4, the width of the cutoff waveguide $w_2=0.8$ mm, the length of the cutoff waveguide path dL=7.2 mm, the dielectric constant of the dielectric vias 5*a*, 5*b*, 5*c*, $\in d=20.0$, the dielectric via diameter b=$\phi$0.2 mm, the dielectric via pitches $a_1$, $a_2$, $a_3=0.5$ mm, and the distances between the via groups $e_1=1.57$ mm, $e_2=1.57$ mm. Further, the dielectric via groups of the resonators 4*a*, 4*b*, 4*c* were arranged in a column along the central axis of the cutoff waveguide path respectively. Further, the dielectric via group of the resonators 4 was arranged at a position displaced by 0.03 mm from the central axis of the cutoff waveguide path.

In this case, a characteristic that the central frequency is 73.3 GHz and the transmittance frequency band width is 0.7 GHz was obtained, and it proves that such a structure functions as a filter having attenuation of −20 dB on both sides of the central frequency±1 GHz.

What is claimed is:

1. A dielectric waveguide type filter using a dielectric waveguide, the waveguide comprising a pair of main conductive layers holding an upper and a lower surfaces of a dielectric therebetween, and groups of conductive vias arranged in the direction of signal transmission with a space of a distance less than ½ of a signal wavelength between the conductive vias and penetrating parts near side walls of a dielectric substrate thus to connect the pair of the main conductive layers with each other, the dielectric waveguide including a resonator, the resonator being constituted by dielectric vias formed of a dielectric having a higher dielectric constant than that of a dielectric forming the dielectric waveguide and provided in a region enclosed by the main conductive layers and the groups of conductive vias.

2. A dielectric waveguide type filter as claimed in claim 1, in which a cutoff waveguide path is formed and the resonator is provided in this cutoff waveguide path.

3. A dielectric waveguide type filter as claimed in claim 1, in which an auxiliary conductive layers are provided for mutually electrically connecting adjacent vias are provided in parallel with the main conductive layers near the side walls of the dielectric waveguide.

4. A dielectric waveguide type filter as claimed in claim 1, in which the resonator has a plurality of dielectric vias.

5. A dielectric waveguide type filter as claimed in claim 4, in which the resonant characteristic of the resonator is controlled by changing positions of the plurality of dielectric vias.

6. A dielectric waveguide type filter as claimed in claim 1, in which the plurality of dielectric vias are arranged on the central axis of the resonator.

7. A dielectric waveguide type filter as claimed in claim 1, in which the plurality of dielectric vias are arranged in symmetrical positions with respect to the central axis of the resonator.

8. A dielectric waveguide type filter as claimed in claim 1, in which a dielectric forming the dielectric waveguide is a low-temperature baked ceramic.

9. A dielectric waveguide type filter as claimed in claim 1, in which the dielectric constant of the dielectric vias is higher than two times the dielectric constant of the dielectric forming the dielectric waveguide.

10. A dielectric waveguide type filter as claimed in claim 1, in which a plurality of the resonator each having a predetermined characteristic are provided and arranged in series.

11. A dielectric waveguide type branching filter including a common dielectric waveguide and a dielectric waveguide type filters, wherein the dielectric waveguide type filters are perpendicular to the common dielectric waveguide, wherein the dielectric waveguide type filters are located on the same side of the common dielectric waveguide, the dielectric waveguide type filter comprising a pair of main conductive layers holding an upper and a lower surfaces of a dielectric therebetween, and groups of conductive vias arranged in the direction of signal transmission with a space of a distance less than ½ of a signal wavelength between the conductive vias and penetrating parts near side walls of a dielectric substrate thus to connect the pair of the main conductive layers with each other.

12. A dielectric waveguide type branching filter as claimed in claim 11, in which the common dielectric waveguide is a dielectric waveguide comprising a second pair of main conductive layers holding an upper and a lower surfaces of a second dielectric therebetween, and second groups of conductive vias arranged in the direction of signal transmission with a space of a distance less than ½ of a signal wavelength between the second groups of conductive vias and penetrating parts near side walls of a second dielectric substrate thus to connect the second pair of the main conductive layers with each other.

13. A dielectric waveguide type branching filter as claimed in claim 11, in which conductive vias for electrically connecting the main conductive layers to each other are provided in a region enclosed by the main conductive layers and the groups of conductive vias.

14. A dielectric waveguide type branching filter including a common dielectric waveguide and a dielectric waveguide type filter, the dielectric waveguide type filter comprising a pair of main conductive layers holding an upper and a lower surfaces of a dielectric therebetween, and groups of conductive vias arranged in the direction of signal transmission with a space of a distance less than ½ of a signal wavelength between the conductive vias and penetrating parts near side walls of a dielectric substrate thus to connect the pair of the main conductive layers with each other, in which dielectric vias having a dielectric constant higher than that of a dielectric forming the dielectric waveguide are provided in a region enclosed by the main conductive layers and the groups of conductive vias.

* * * * *